US007624882B2

(12) United States Patent
Commandeur et al.

(10) Patent No.: US 7,624,882 B2
(45) Date of Patent: Dec. 1, 2009

(54) TIE-BACK SYSTEM FOR CRANES, IN PARTICULAR HEAVY LOAD OFFSHORE CRANES

(75) Inventors: Johan Albert Commandeur, Zwijndrecht (NL); Michael Franciscus Maria van Marrewijk, Honselersdijk (NL); Wilhelmus Coenradus Johannes Jozephus Woldring, Rotterdam (NL)

(73) Assignee: Gusto B.V., Schiedam (NL)

( * ) Notice: Subject to any disclaimer, the term of this patent is extended or adjusted under 35 U.S.C. 154(b) by 0 days.

(21) Appl. No.: 12/065,703

(22) PCT Filed: Sep. 6, 2006

(86) PCT No.: PCT/NL2006/050224

§ 371 (c)(1),
(2), (4) Date: Mar. 4, 2008

(87) PCT Pub. No.: WO2007/030015

PCT Pub. Date: Mar. 15, 2007

(65) Prior Publication Data

US 2008/0251484 A1 Oct. 16, 2008

(30) Foreign Application Priority Data

Sep. 6, 2005 (EP) ..... 05108173

(51) Int. Cl.
*B66C 23/68* (2006.01)

(52) U.S. Cl. ..... 212/298; 212/175; 212/309

(58) Field of Classification Search ..... 212/175, 212/298, 301, 309
See application file for complete search history.

(56) References Cited

U.S. PATENT DOCUMENTS 2,186,372 A * 1/1940 Elgh ..... 212/298
2,189,212 A * 2/1940 Ljungkull ..... 212/298

(Continued)

FOREIGN PATENT DOCUMENTS

DE 12 46 969 B 8/1967
JP 07 187576 A 7/1965
JP 54-104156 A * 8/1979

OTHER PUBLICATIONS

International Search Report of the corresponding PCT International Application No. PCT/NL2006/050224, dated May 23, 2007.
English Abstract of JP Publication No. 07 187576 A.

*Primary Examiner*—Thomas J Brahan
(74) *Attorney, Agent, or Firm*—Young & Thompson

(57) ABSTRACT

The invention relates to a tie-back system for a crane comprising a rotatable base with a generally vertical support frame and a lifting arm which is with a lower end hingedly connected to the base in a hinge point, an upper part of the frame carrying a displacement member movable relative to the frame, the displacement member carrying a first cable guide means, a first cable extending from a first connection point on the arm along the first cable guide means to a first pulling device.

Figure 1:
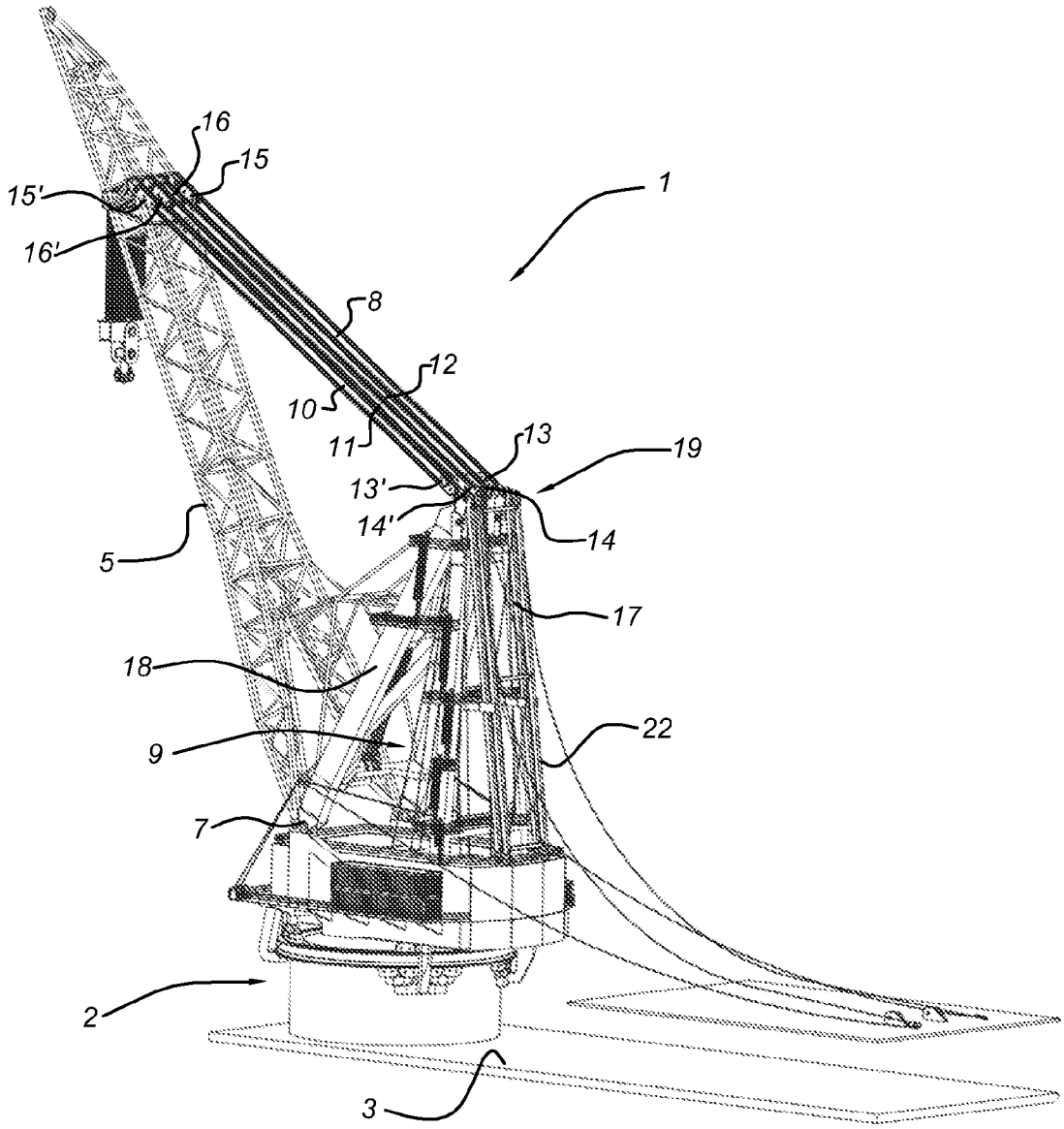

The displacement member comprising a tie connection point for connection to a tie member, a second cable guide means attached to an upper part of the frame and a second cable extending from a second connection point on the arm along the second cable guide means to a second pulling device.

The frame comprising a stop part situated near the displacement member, wherein in a load transfer position the displacement member engages with the stop part for transferring a load on the first cable guide means to the frame, the displacement member in a tie-back position being disengaged from the stop part for transferring a load on the first cable guide means to a tie member which in the tie-back position is one side attached to a connection point at a distance from hinge point of the lifting arm, and on the other side to the tie connection point of the displacement member.

7 Claims, 6 Drawing Sheets

U.S. PATENT DOCUMENTS 2,443,306 A * 6/1948 De Cuir ..... 212/299
2,515,777 A * 7/1950 King et al. ..... 212/300
2,609,939 A * 9/1952 Davidson et al. ..... 212/298
3,433,368 A * 3/1969 Durand ..... 212/295
3,923,163 A 12/1975 Brewer
4,557,391 A * 12/1985 Poock et al. ..... 212/270
4,579,234 A * 4/1986 Delago et al. ..... 212/178
4,664,269 A 5/1987 van Ketel

* cited by examiner

TIE-BACK SYSTEM FOR CRANES, IN PARTICULAR HEAVY LOAD OFFSHORE CRANES

This application claims the benefit of International Application No. PCT/NL2006/050224 filed on Sep. 6, 2006 under 35 U.S.C. §371,entitled, "TIE-BACK SYSTEM FOR CRANES, IN PARTICULAR HEAVY LOAD OFFHORE CRANE" which itself claims the benefit of European Patent Application No. 05108173.5, filed on Sep. 6, 2005, both of which are incorporated herein by reference in their entirety.

The invention relates to a tie-back system for cranes, in particular offshore cranes for heavy loads such as between a 1000-10.000 tons. In offshore cranes, tie-back systems are used for increasing the outreach of the boom without overloading the main components of the crane. The tie-back system connects the top of the crane frame to a distant position on deck, such that only restricted slewing of the crane is possible. Such a tie-back system is known from U.S. Pat. No. 4,664,269 in the name of the applicant. In the above prior art reference, an offshore crane has a boom that is connected to the top of an A-frame via a detachable boom hoist block. Via a guide construction and a hoist wire, the block is detached from the A-frame and the boom hoist is attached to a pad eye on deck, at a distance from the heel point of the boom. In this way, the boom can be hinged to a more horizontal position while the load in the boom hoist cables attached to the tie-back rod or cable is equal to the load in the boom hoist ropes, such that the known crane is statically determined. Disconnecting the boom hoist blocks from the A-frame is a relatively difficult operation which requires a large number of actions on deck and which is relatively time consuming.

The invention also relates to a method of applying a tie-back member to a crane.

It is an object of the present invention to provide a tie-back system of the above mentioned type and a method of applying the same, which is relatively simple and which allows fast and safe deployment and demobilisation. It is also an object of the present invention to provide a tie-back system, which allows making the tie-back system an integral part of the crane without the need for additional storage of equipment. Furthermore, it is an object of the present invention to provide a tie-back system which provides a passive a fail safe force transfer mechanism for varying loads in the tie-back system.

Hereto the present invention provides a crane comprising a rotatable base with a generally vertical support frame and a lifting arm which is with a lower end hingedly connected to the base in a hinge point, an upper part of the frame carrying a displacement member movable relative to the frame, the displacement member carrying a first cable guide means, a first cable extending from a first connection point on the arm along the first cable guide means to a first pulling device, the displacement member comprising a tie connection point for connection to a tie member, a second cable guide means attached to an upper part of the frame and a second cable extending from a second connection point on the arm along the second cable guide means to a second pulling device, the frame comprising a stop part situated near the displacement member, wherein in a load transfer position the displacement member engages with the stop part for transferring a load on the first cable guide means to the frame, the displacement member in a tie position being disengaged from the stop part for transferring a load on the first cable guide means to a tie member which in the tie position is one side attached to a connection point at a distance from hinge point of the lifting arm, and on the other side to the tie connection point of the displacement member.

The crane according to the present invention provides a simple and fast tie-back system, in which detaching of the hoist blocks at the frame side is no longer required. The tie cables or rods of the tie-back system of the present invention can be rapidly deployed with minimal deck operations being required. The tie members are deployed by:

- placing a load on the second cable
- slackening of the first cable such that the displacement member moves away from the stop surface,
- attaching a tie member with one end to an attachment point at or near the height of the base, at a distance from the hinge point, which tie member with its other end is connected to the attachment member, and
- placing a load on the first cable while maintaining the displacement member at a distance from the stop member.

When the load is transferred from the boom hoist cable extending between the top of the A-frame and the boom, the displacement member is pivoted to come free from the A-frame, either by the weight of the tie members, and/or by means of a winch. The tie rods can be unfolded and attached to deck level, which is the only deck operation carried out. Instead of tie rods it is also possible to use cables without departing from the invention.

The movable displacement member forms a fail-safe passive compensator which effectively evens out load variations in the tie rods and hoist cables.

In one embodiment according to the present invention, the tie member comprises a first rod, hingedly connected to the tie connection point of the displacement member and a second rod, hingedly attached to the first rod and in a load transfer position substantially parallel to the first rod and in the tie position extending substantially in line with the first rod. The tie-back rods can remain connected to the displacement member and can be folded back against the crane frame when not in use so that no additional on board storage space is required.

Figure 3:
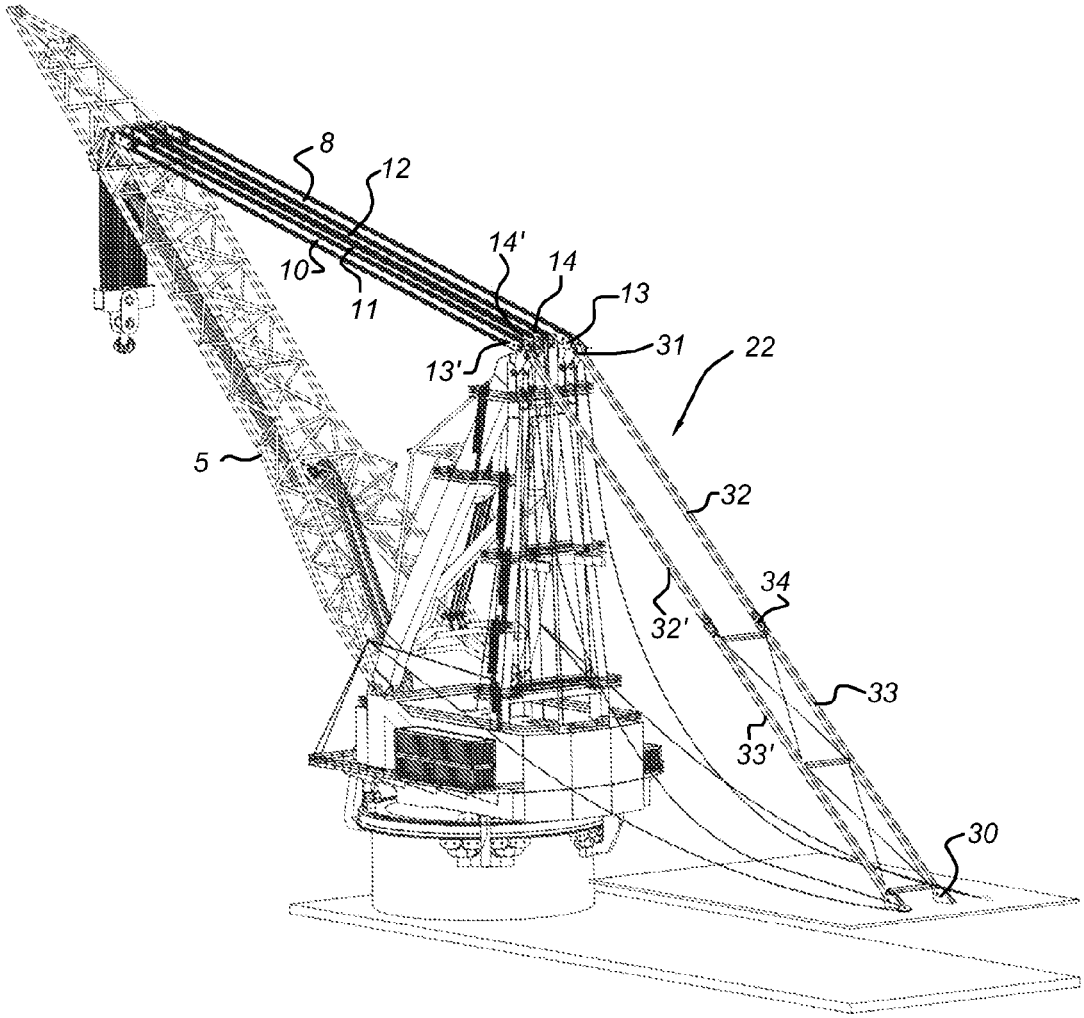
Figure 4:
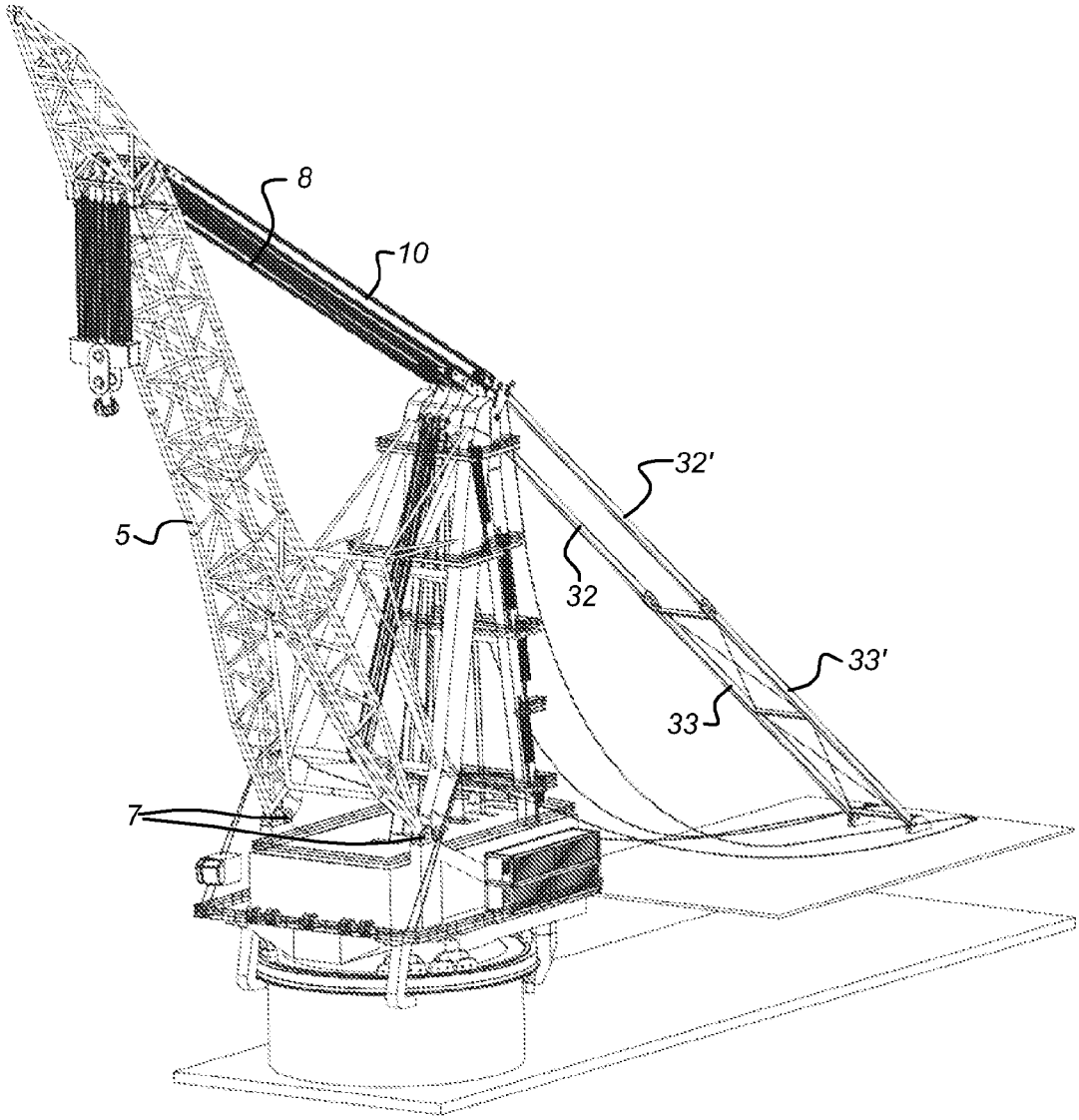
Figure 5:
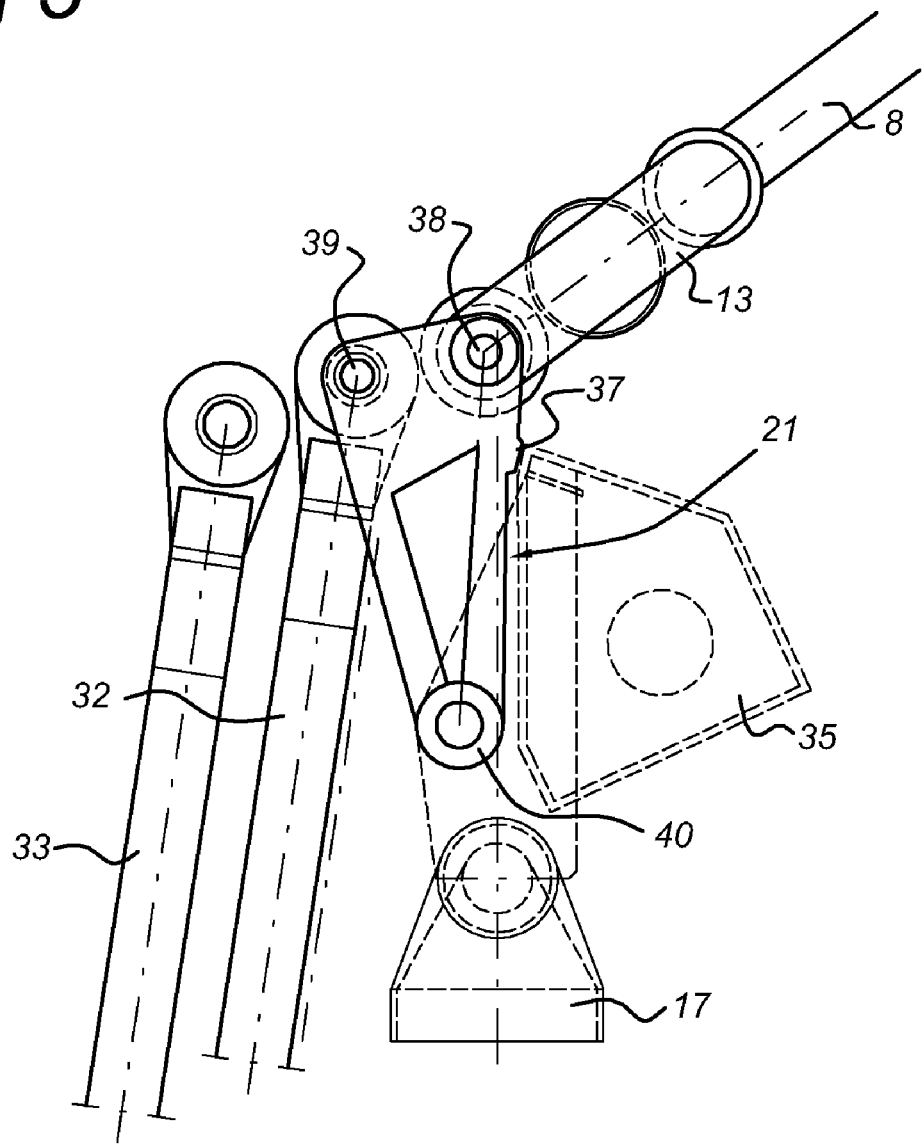
Figure 6:
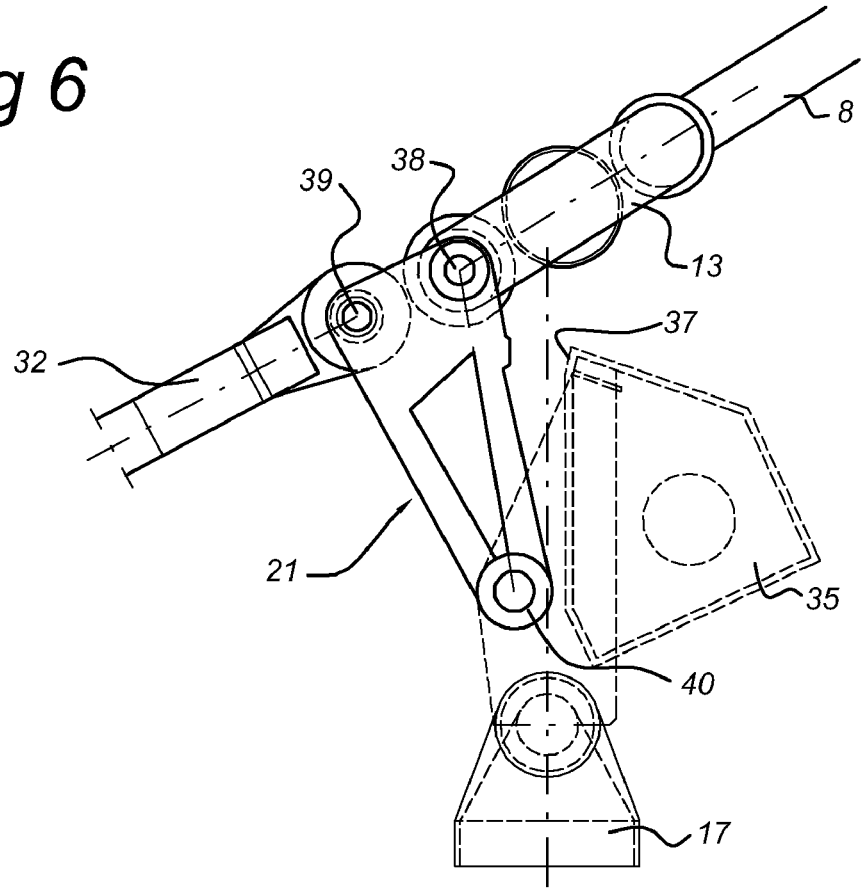
Figure 7:
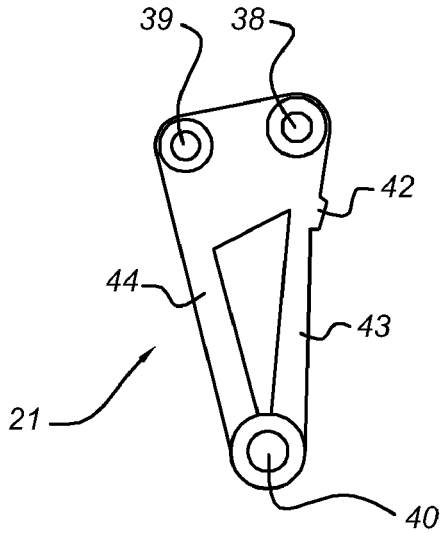

An embodiment of a crane according to the present invention will, by way of non-limiting example, be described with reference to the accompanying drawings. In the drawings:

FIG. 1-4 shows the sequence of deployment of the tie-back system of a crane according to the present the invention, FIG. 5 shows the attachment, or force transfer member of the present invention with the tie-back system in the non-operational, or "slewing" state, FIG. 6 shows the attachment member of the present invention with the tie-back system in the operational or "fixed" state, and FIG. 7 is a plan view of a generally triangular force transfer member.

FIG. 1 shows an offshore crane 1 which has a slewing support 2 placed on deck of a floating structure 3 such as a vessel, or barge. A boom 5 is connected to the support 2 in a hinge point 7 and is connected to an A-frame 9 via four boom hoists tackles 8, 10,11,12. (Each tackle may comprise multiple cables, such as for instance 25 cables each). The A-frame 9 comprises a substantially vertical leg 17 and an angled leg 18. Each boom hoist tackle 8,10-12 is connected to an upper part 19 of the A-frame 9 via a respective pulley block 13,13', 14,14' on one end, and to the boom 5 via a pulley block 15,15',16,16'. The central pulley blocks 14,14' are directly connected to the upper part 19 of the A-frame, whereas the outward pulley blocks 13,13' are connected to a movable force transfer member 21 (see FIGS. 2, 5 and 6) that is hingedly connected to the upper A-frame part 19. A hinging tie rod system 22 is also connected to the A-frame 9 via the force transfer member 21. In the slewing position shown in FIG. 1, the force transfer member transfers the force of the outer boom hoist tackles 8,10 to the A-frame.

Figure 2:
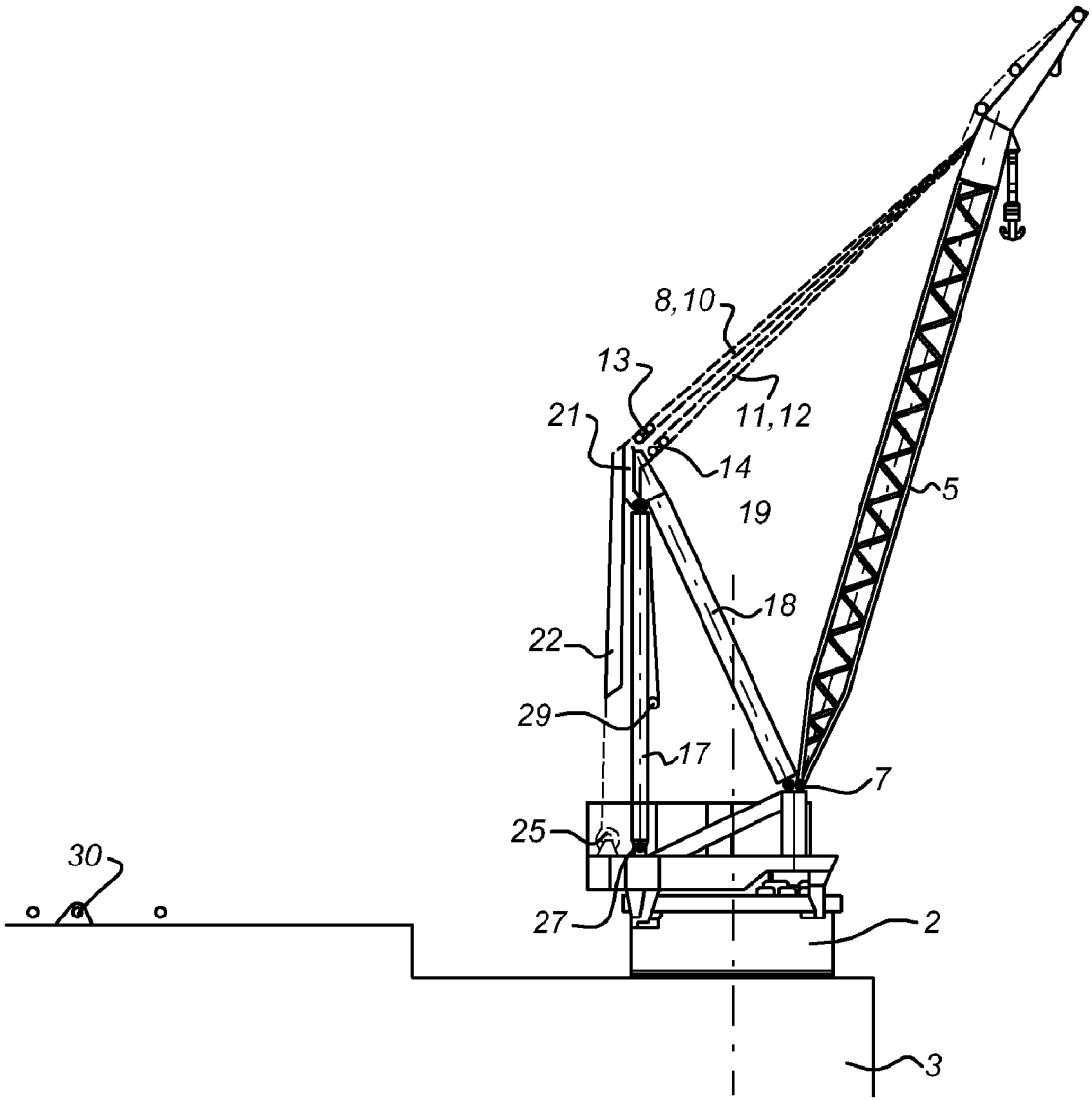

FIG. 2 shows a side view of the crane 1, in which it can be seen that outer hoist tackles 8, 10 are connected to a winch 25 and inner hoist cables 11,12 are connected to a winch 27. In the slewing mode, both winches 25,27 cooperate and load sharing between these winches is carried out by electric load control sharing the load of the boom 5 between the winches 25,27. The tie rods 22 are folded against the vertical leg 17 of the A-frame. In the tie-back mode, the tie rods 22 are lowered via a lowering winch 29 and are connected with one end to a pad eye 30 on deck of the vessel 3. This is shown in FIG. 3, in which it can be seen that the tie rods 22 comprise a first tie rod 32, hingingly connected to the force transfer member 21 in a tie connection point 31. A second tie-rod is attached to the tie-rod 32 in a hinge point 34 and is attached via pins to the pad eyes 30. In this fixed mode, the inner pulley blocks 14,14' are moved away from the A-frame such that the load of the tackles 8,10 is transferred directly to the tie rods 32, 32', 33,33'. Now the boom 5 can be hinged outwardly about hinge point 7, as shown in FIG. 4. The boom may be moved up and down depending on the position where the load that is picked up on where it should be put down.

FIG. 5 shows the force transfer member 21, in the slewing mode. The force transfer member 21 is connected in a hinge point 40 at its apex to the vertical leg 17 of the A-frame 9. In the force transfer position, the transfer member 21 engages with a stop surface 37 at the top part 35 of the angled A-frame leg 18. Hoist blocks 13, 13' are each attached to a respective transfer member 21 in corner point 38, whereas tie rods 32, 32' are connected to a respective force transfer member 21 in corner point 39. The force in the boom hoist tackles 8,10 is transferred via the force transfer members 21 to the top part 35 of the A-frame 9.

By slackening of the tackles 8,10 that are connected to the force transfer member 21, via the winch 25, the member 21 can pivot around the hinge point 40 such that the transfer member is disengaged from the stop surface 37 at the end part 35 of angled A-frame leg 18, as is shown in FIG. 6. By means of the winch 29 the tie rods 32, 33 are hinged away from the force transfer member 21 to be connected to the pad eye 30 on deck. In the force transfer, or "fixed" position as shown in FIG. 6, the winch 25 is actuated such that boom hoist cables 8, 10 are hauled in so far that the tension in the cables 8,10 becomes equal to the tension in the boom hoist cables 11,12. Now the crane can operate in the same manner as in the slewing mode. The control system of the boom hoist winches will keep control over the load sharing of both systems. The force transfer member 21 in the fixed mode keeps the loads between the tie back rods 32,32'33,33' and the boom hoist blocks 13, 13' equalized and transfers load components to the A-frame 9 when the tie back rods 32,32',33,33' and the boom hoist cables 8,10-12 are not in line.

As is shown in FIG. 7, the force transfer member 21 is of generally triangular shape, with two arms 43,44 and a base arm 45. The hinging connection 40 to the A-frame is at the apex of the triangle, whereas at both ends of the base arm 45 the hinging connections 38,39 to the hoist block 13 and to the tie rod 32, respectively, are situated.

Even though in the above examples, the force transfer member 21 is shown to be a triangular hinge arm, it is also possible to employ alternative force transfer members, such as sliding force transfer members or hydraulically actuated force transfer members without departing from the present invention.

The invention claimed is:

1. A crane comprising:

a generally vertical substantially A-shaped support frame comprised of a substantially vertical first leg and a second leg located at an angle with the first leg, an upper end of the second leg connected to an upper end of the first leg;

a rotatable base supporting the support frame;

a lifting arm having a lower end hingedly connected to the base at a hinge point, the lifting arm having first and second connection points;

a movable displacement member supported by the upper end of the first leg, the displacement member comprising a tie connection device;

a tie member connected with a first side to the tie connection device and a second side attached to a tie connection point situated at a horizontal distance from the support frame and at a height near a lower end of the support frame;

a first cable guide means carried by the displacement member;

first and second pulling devices;

a first cable extending from the first connection point on the lifting arm along the first cable guide means to the first pulling device;

a second cable guide means attached to an upper end of the support frame;

a second cable extending from the second connection point on the lifting arm along the second cable guide means to the second pulling device; and a stop part located on the second leg of the support frame, the stop part situated near the displacement member, wherein, in a load transfer position, the displacement member engages with the stop part for transferring a load on the first cable guide means to the second leg of the frame, and in a tieback position, the displacement member is disengaged from the stop part by the tie member connected with the first side to the tie connection device and the second side attached to the tie connection point at the horizontal distance from the support frame at the height near the lower end of the support frame.

2. The crane according to claim 1, wherein the displacement member comprises a substantially triangular body with an apex point hingedly connected to the first leg of the support frame, and with the first cable guide means and the tie connection device being situated at or near respective corners along a base of the triangular body.

3. The crane according to claim 1, wherein, the tie member comprises a first rod hingedly connected to the tie connection device of the displacement member and a second rod hingedly attached to the first rod, and in the load transfer position, the second rod is substantially parallel to the first rod, and in the tieback position, the second rod extends substantially in line with the first rod.

4. The crane according to claim 1, wherein the stop part is a stop surface located near the upper end of the second leg of the support frame.

5. The crane according to claim 1, comprising:

at least two of said displacement member;

at least two of said first cable guide means, each said first cable guide means attached to a respective said displacement member; and at least two of said second cable guide means, each said second cable guide means guiding a respective cable.

6. A crane, comprising:

a rotatable base;

a generally vertical support frame supported by the base;

a lifting arm with a lower end hingedly connected to the base in a hinge point, the lifting arm having first and second connection points;

a displacement member carried by an upper part of the support frame and movable relative to the support frame, the displacement member comprising a tie connection point;

a first cable guide means carried by the displacement member;

first and second pulling devices;

a first cable extending from the first connection point on the lifting arm along the first cable guide means to the first pulling device;

a tie member connected to the tie connection point, the tie member comprising i) a first rod hingedly connected to the tie connection point of the displacement member and ii) a second rod hingedly attached to the first rod;

a second cable guide means attached to an upper part of the support frame;

a second cable extending from the second connection point on the lifting arm along the second cable guide means to the second pulling device;

a stop part located on the frame, the stop part situated near the displacement member, wherein, in a load transfer position, the displacement member engages with the stop part for transferring a load on the first cable guide means to the support frame, in a tieback position, the displacement member is disengaged from the stop part for transferring a load on the first cable guide means to the tie member, the tie member having a first side connected to a connection point at a distance from hinge point of the lifting arm and a second side connected to the tie connection point of the displacement member, in the load transfer position, the second rod is substantially parallel to the first rod, and in the tieback position, the second rod extends substantially in line with the first rod.

7. A crane, comprising:

a rotatable base;

a generally vertical support frame supported by the base, the support frame being substantially A-shaped with a substantially vertical first leg and a second leg, the second leg located at an angle with the first leg and having an upper end connected to the upper end of the first leg;

a lifting arm with a lower end hingedly connected to the base in a hinge point, the lifting arm having first and second connection points;

a displacement member carried by an upper end of the first leg of the support frame and movable relative to the support frame, the displacement member comprising a tie connection point;

a first cable guide means carried by the displacement member;

first and second pulling devices;

a first cable extending from the first connection point on the lifting arm along the first cable guide means to the first pulling device;

a tie member connected to the tie connection point;

a second cable guide means attached to an upper part of the support frame;

a second cable extending from the second connection point on the lifting arm along the second cable guide means to the second pulling device; and a stop part located on the frame, the stop part situated near the displacement member, the stop part being a stop surface located at an upper end of the second leg of the support frame, wherein, in a load transfer position, the displacement member engages with the stop part for transferring a load on the first cable guide means to the support frame, in a tieback position, the displacement member is disengaged from the stop part for transferring a load on the first cable guide means to the tie member, in a tieback position, the displacement member is disengaged from the stop part for transferring a load on the first cable guide means to the tie member, the tie member having a first side connected to a connection point at a distance from hinge point of the lifting arm and a second side connected to the tie connection point of the displacement member.

* * * * *